US005229540A

United States Patent [19]

Schabdach et al.

[11] Patent Number: 5,229,540

[45] Date of Patent: Jul. 20, 1993

[54] TANK ALERTING SYSTEM

[75] Inventors: Paul G. Schabdach, Churchville; Irving F. Barditch, Baltimore, both of Md.

[73] Assignee: The United States of America as represented by the Secretary of the Army, Washington, D.C.

[21] Appl. No.: 888,995

[22] Filed: May 26, 1992

[51] Int. Cl.[5] ..... F41H 11/02

[52] U.S. Cl. ..... 89/41.03; 89/1.11; 342/20

[58] Field of Search ..... 89/36.17, 41.03, 41.06, 89/41.07, 1.11; 102/402, 405, 427, 505; 342/12, 20

[56] References Cited

U.S. PATENT DOCUMENTS 4,222,306 9/1980 Maury ..... 102/505

FOREIGN PATENT DOCUMENTS 2036935 7/1980 United Kingdom ..... 342/12

*Primary Examiner*—Stephen C. Bentley

*Attorney, Agent, or Firm*—Anthony T. Lane; Edward Goldberg; Michael C. Sachs

[57] ABSTRACT

A low cost warning system for armored vehicles which uses multiple sensors containing detectors for IR and millimeter wave signals emanated by attacking missiles and/or projectiles to allow the launching of screening grenades. The sensors telemeter their coded signals to a receiver inside the vehicle which process the coded signals to direct the exercise of an active screening defense.

4 Claims, 1 Drawing Sheet

TANK ALERTING SYSTEM

The invention described herein may be manufactured, used and licensed by or for the Government for Governmental purposes without pay to us of any royalties thereon.

BACKGROUND OF THE INVENTION

Field of Invention

This invention relates generally to the field of active defense systems whose function is to reduce the lethality of missile or rocket anti-tank threats.

It further relates to that field of anti-tank defenses which provided early warning of a pending attack allowing for an active defense of the armored fighting vehicle.

Background of the Invention

Armored vehicles in combat are vulnerable to a variety of anti-tank threats from the ground and air. The tank crew in current modern fighting vehicles using their eyesight and assisted with various optical instruments to enhance its eyesight defend the fighting vehicle by using passive defenses such as smoke screens, taking advantage of the speed of the armored vehicle and by having infantry outside the armored vehicle to protect it from enemy armor vehicular killer teams.

However such defenses are easily overcome by manned stand-off platforms in the air such as helicopters or on the ground which can stand-off beyond the range of the fighting vehicle. Such new platforms can illuminate or designate the armored vehicle with laser energy to allow the homing of a seeker warhead or these very platforms could launch active guided missile warheads that are "smart" and can guide onto the armored vehicle using the visual picture of the vehicle itself or emanations from the armored vehicle itself such as the infra-red radiation emanated from the hot engines of the armored vehicle or from the protective armor of the vehicle itself.

This invention, however, allows the armored vehicle the opportunity to better defend itself and to survive on the modern battlefield by providing a warning system of an impending attack by a missile or projectile due to their own emanations and thereafter triggering active screening to cause the designation or guidance systems of the oncoming missile or warhead to malfunction.

SUMMARY OF INVENTION

It is the object of this present invention to provide an improved scheme for the protection of armored vehicles against missile and projectile attack by providing early warning and proper screening using smoke grenades.

It is another object of this invention to provide a system which effectively warns and defends against Infra-red(IR) and Milli-meter wave(MMW) threats, emitted signatures from incoming warheads and/or missiles.

It is a further object of this invention to provide a low cost armored vehicle early warning and defense system.

It is the further object of this invention to establish the design of an effective armored vehicle tank alerting system.

The system embodies two separate subsystems. One subsystem attached externally to a vehicle contains dual sensors to detect milli-meter wave and infra-red threats.

The second subsystem receives the signals from the sensors and alerts the operators of the armored vehicle with the initiation of response being able to be accomplished automatically.

These and other objects of the invention will become apparent to those skilled in the art upon consideration of the following description of the invention.

DETAILED DESCRIPTION OF THE PREFERRED EMBODIMENT

Figure 1:
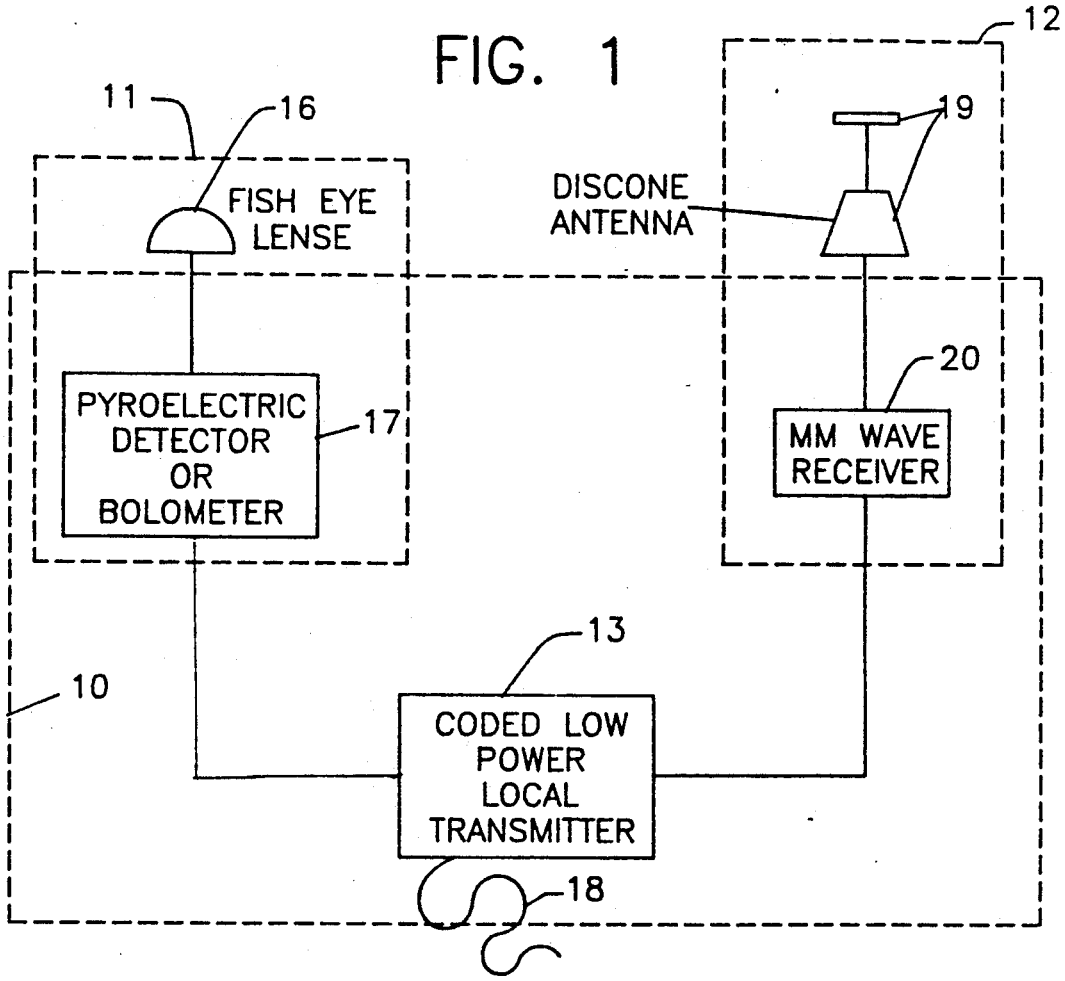
FIG. 1 is a flow diagram of the functional design of one typical dual sensor box which is packaged and attached to the outside of the armored vehicle depicting the subsytems for the detection of the threats.

Turning now to FIG. 1, it shows the sensor box 10 which can detect infra-red and milli-wave signal threats. Such sensor boxes 10 are attached outside the armored vehicle at each of the vehicle's quadrants. Each sensor box 10 has an Infra-red detector 11 and a millimeter wave detector 12. Further contained in each sensor box 10 is a coded warning transmitter 13 for transmission to a local receiver 14 inside the vehicle relaying information as to which sensor box 10 is activated to the vehicle warning and control system 15.

Within the infra-red detector 11, detection is carried out by a small fisheye lens 16 which can detect the scattered IR from an incoming seeking missile. This scattered IR impacting any targeted object is subject to omni-directional scattering. The lens 16 concentrates this radiation on a pyroelectric detector 17 or low thermal inertia bolometer 17 which activates the coded local transmitter 13.

Within the milli-meter wave detector 12, detection is carried out by a discone antenna 19 which can detect the scattered milli-meter waves from a seeking missile. The antenna 19 is omnidirectional similar to the IR fish eye lens 16. The discone antenna 19 feeds a miniaturized 94 Ghz transmitter/receiver 20. This transmitter/-receiver 20 provides its signals to the warning local transmitter 13 which telemeters 18 the coded data to the local receiver 14 inside the armored vehicle. The fish eye lens 16 may be mounted on top of the discone antenna 19.

The coded warning transmitter 13 could be eliminated by hard wiring the detectors 11,12, thus eliminating the need for radio transmissions. Such an alternate embodiment, however, would compromise the integrity of the armored hull due to the need to penetrate in multiple locations the hull to pass the interconnecting wires.

Figure 2:
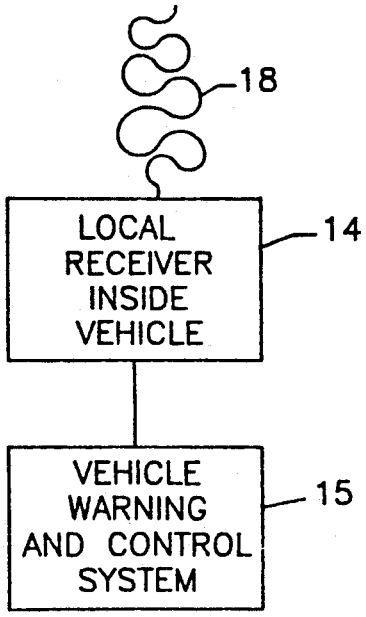
FIG. 2 is a flow diagram depicting the functional design of the subsystem which receives the coded sensor signals for processing by a local receiver inside the vehicle.

Turning now to FIG. 2, the local receiver 14 found inside the vehicle receives the coded telemetered signals 18 and sends such signals 18 to the vehicular warning and control system 15 for processing, alerting the vehicle commander or not only alerting the operators but also automatically initiating grenade launches. The coded signals provide directional information for the launch of the launcher grenades. The entire system comprising FIG. 1 and FIG. 2 can be built for relatively little; hence providing a low cost defense system.

While the invention has been described in conjunction with a specific embodiment, it is evident that many alternatives, modifications and variations will become apparent to those skilled in the art in light of the foregoing description. Accordingly, it is intended that the present invention embrace all such alternatives, modifications, and variations as fall within the spirit and broad scope of the appended claims.

What is claimed is:

1. An armored vehicle warning and defensive system against missile and warhead attack comprising:

a plurality of sensor means, each sensor means including a plurality of infrared and millimeter wave detectors all of which detectors are connected to a single low power local transmitter associated respectively and located within each said sensor means, said local transmitter generating coded signals in response to an output from any detector in said respective sensor means;

means within the armored vehicle to receive any of said coded signals from any of said sensor means local transmitters; and means to process and initiate warning to launch screening grenades against an incoming attacking missile or warhead in response to such receipt of any of said coded signals.

2. The armored vehicular warning and defensive system of claim 1 wherein the means to receive the coded signals from the multiple sensors comprises a local receiver inside the vehicle.

3. The armored vehicular warning and defensive system of claim 1 wherein an IR detector comprises:

a fish eye lens to collect the scattered IR waves;

a pyroelectric detector which receives collected IR waves to activate the coded local transmitter.

4. The armored vehicular warning and defensive system of claim 1 wherein each milli-wave detector comprises:

an omnidirectional discone antenna to collect the scattered waves;

a millimeter wave receiver at 94 Ghz to receive the millimeter signals and to provide them to the coded low power transmitter.

* * * * *